US009986617B2

(12) United States Patent
Hollander

(10) Patent No.: US 9,986,617 B2
(45) Date of Patent: May 29, 2018

(54) LIGHT-EMITTING DIODE ELECTRICAL CIRCUITRY FOR ILLUMINATION

(71) Applicant: Metrolight Ltd., Netanya (IL)

(72) Inventor: Jonathan Hollander, Petach Tikva (IL)

(73) Assignee: Metrolight Ltd., Netanya (IL)

( * ) Notice: Subject to any disclaimer, the term of this patent is extended or adjusted under 35 U.S.C. 154(b) by 0 days. days.

(21) Appl. No.: 15/406,805

(22) Filed: Jan. 16, 2017

(65) Prior Publication Data

US 2017/0215246 A1 Jul. 27, 2017

Related U.S. Application Data

(60) Provisional application No. 62/281,206, filed on Jan. 21, 2016.

(51) Int. Cl.
*H05B 33/08* (2006.01)
*H05B 37/02* (2006.01)

(52) U.S. Cl.
CPC ..... *H05B 33/089* (2013.01); *H05B 37/0272* (2013.01)

(58) Field of Classification Search
None
See application file for complete search history.

(56) References Cited

U.S. PATENT DOCUMENTS

2002/0050799 A1* 5/2002 Yamauchi ..... H05B 37/0245 315/307
2013/0119890 A1* 5/2013 Feng ..... H05B 33/0845 315/291
2013/0249437 A1 9/2013 Wang
2014/0159616 A1 6/2014 Wang
2015/0382417 A1* 12/2015 Chou ..... H05B 33/0815 315/291

FOREIGN PATENT DOCUMENTS

EP 2642829 A1 9/2013
EP 2741585 A2 6/2014
WO WO2013162308 10/2013
WO WO2014110840 A1 7/2014
WO WO201413587 9/2014

* cited by examiner

*Primary Examiner* — Jany Richardson
(74) *Attorney, Agent, or Firm* — Dr. Hanan Farber Patent Agent Ltd.

(57) ABSTRACT

A switch module mountable in a switch box including a switch with a first terminal connectable to the live wire input and a second terminal, a driver circuit with input from the second terminal of the switch and with an output connected to the live wire output. The driver circuit outputs electrical power to the lighting circuit over the live wire output to LED lamp fixtures. The switch module includes a controller connected to the driver circuit. The controller is configured to control at least one of voltage, current, pulse width and pulse duty cycle of the electrical power to the lighting circuit.

16 Claims, 9 Drawing Sheets

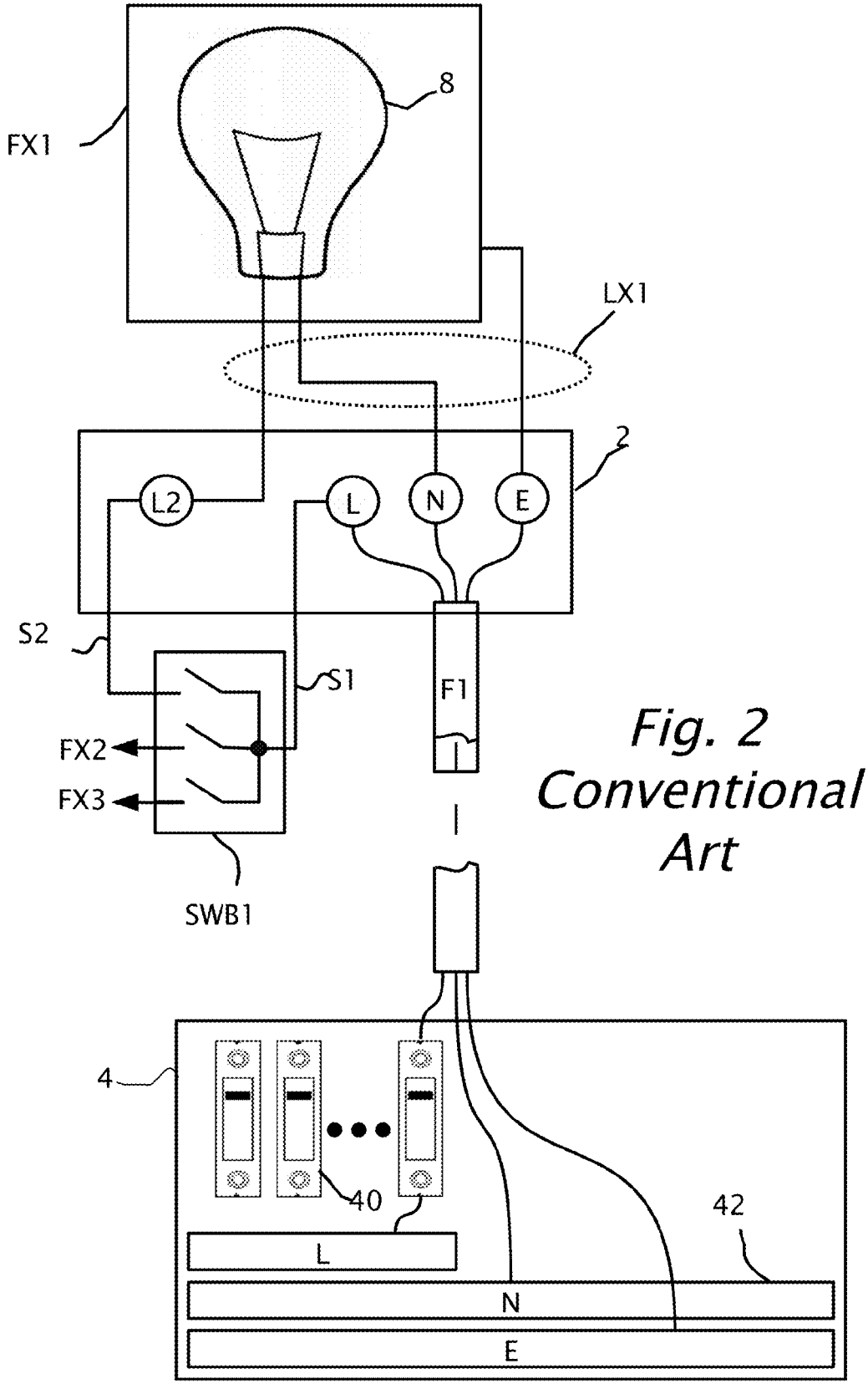
Fig. 2
Conventional
Art

LIGHT-EMITTING DIODE ELECTRICAL CIRCUITRY FOR ILLUMINATION

BACKGROUND

1. Technical Field

The present invention relates to lighting installations which include lighting fixtures which utilize light emitting diodes (LEDs) for illumination 2. Description of Related Art Light emitting diodes (LEDs) are becoming more widely used in consumer lighting applications. In consumer installations, one or more LED dies (or chips) are mounted within a LED package or on a LED module, which may make up part of a LED light fixture. Various implementations of LED lighting fixtures are becoming available in the marketplace to fill a wide range of applications. LEDs offer improved light efficiency, a longer lifetime, lower energy consumption and reduced maintenance costs, as compared to filament and/or discharge light sources for example.

LED lamps are made of arrays of SMD modules that replace incandescent or compact fluorescent light bulbs, mostly replacing incandescent bulbs rated from 5 to 60 watts. Such lamps are made with standard light bulb connections and shapes, such as an Edison screw base and are compatible with the AC mains voltage generally supplied to the sockets. LED lamps generally include driver circuitry to rectify the AC power and internally convert the voltage to an appropriate value.

A typical illumination LED has a forward voltage threshold between 2 and 4 Volts of DC. A series string of ten LEDs may require 33 VDC forward voltage to light with a drive current of 350 mA.

BRIEF SUMMARY

Various switch modules configured to switch a lighting circuit are provided herein. The switch modules are mountable in a switch box. The switch box includes a live wire input configured to receive electrical power over a live wire from a power source and the switch box includes a live wire output. The switch module includes a switch with a first terminal connectable to the live wire input and a second terminal. The switch module includes a driver circuit with input from the second terminal of the switch and with an output connected to the live wire output. The driver circuit outputs electrical power to the lighting circuit over the live wire output. The switch module includes a controller connected to the driver circuit. The controller is configured to control at least one of voltage, current, pulse width and pulse duty cycle of the electrical power to the lighting circuit. The controller may be configured to analyze the electrical power to the lighting circuit to indicate the temperature of the lighting circuit to control at least one of voltage, current, pulse width and pulse duty cycle of the electrical power to the lighting circuit responsive to the temperature. The switch module may include a communications module operable to communicate with the power source to control voltage output of the power source and/or to communicate with a computer system to control power used in the lighting circuit. The power supply may be located inside or in the vicinity of an electrical panel.

Various light emitting diode (LED) lighting fixtures and/or LED lamp bulbs are provided herein. The LED light fixtures include: a string of light emitting semiconductor diodes (LEDs) and a resistor connected in parallel with the string of LEDs. A value of the resistor is selected to indicate current rating of the lighting fixture. A capacitor is connected in parallel to the resistor and to the string of LEDs. Active driver components are absent from the LED lighting fixture. During in-situ test of the LED lighting fixture, the parallel-connected resistor may be configured to provide a voltage drop detectable by a driver of the LED lighting fixture to indicate the current rating of the LED lighting fixture. During operation, the parallel-connected capacitor is configured to provide a transient detectable by a driver of the LED lighting fixture which indicates a change in load during operation. A series inductor may be connected in series with the string of LEDS to control load and current through the LED lighting fixture during operation.

Various lighting circuit kits are provided herein. The lighting circuit kit includes a switch module configured to switch the lighting circuit. The switch module is mountable in a switch box including a live wire input configured to receive electrical power over a live wire from a power source. The switch box includes a live wire output. A neutral wire may be absent in the switch box. The switch module includes a switch with a first terminal connectable to the live wire input and a second terminal. The switch module includes a driver circuit with input from the second terminal of the switch. The driver circuit outputs electrical power to the lighting circuit over the live wire output. A microcontroller connects to the driver circuit. The controller is configured to control any of voltage, current, pulse width and pulse duty cycle of the electrical power to the lighting circuit. The lighting circuit kit includes a light emitting diode (LED) lighting fixture including a string of light emitting semiconductor diodes (LEDs. A passive electronic component may be connected to the string of LEDs. A value of the passive electronic component may be selected to indicate current rating of the lighting fixture. Active driver components may be absent from the LED lighting fixture. The switch module may include a communications module operable to communicate with the power source to control voltage output of the power source and/or to communicate with a computer system to control voltage current through the LED lighting fixture. The passive electronic component may include a resistor connected in parallel with the string of LEDs and a value of the resistor is selected to indicate current rating of the lighting fixture. A capacitor may be connected in parallel to the resistor configured to provide a transient detectable by the driver of the LED lighting fixture which indicates a change in load during operation. The passive electronic component may includes an inductor connected in series with the string of LEDs. The inductor may be selected to control load and current through the string of LEDs.

Various methods are provided herein for controlling a lighting circuit. The lighting circuit includes a LED lighting fixture having a string of light emitting semiconductor diodes (LEDs) and passive components. A controlled driver of the LED lighting fixture is relocatable with a switch of the lighting circuit and mountable in a switch box. The switch box includes a live wire input from a power source and a live wire output but no neutral wire. Upon the switch being turned on, an initial current flows through the light fixture and a voltage drop is measured responsive to the initial current.

Current is driven to the lighting fixture to operate the lighting fixture. The current level during operation is responsive to the measured voltage drop. During operation change/drop in voltage is monitored. If a change in voltage is sensed during operation, then lighting circuit is turned off. A current level is reset for further operation responsive to an initial current after turn-off. The controlled driver is initially powered from the initial current between the live wire in the switch box through the light fixture.

Various methods are provided herein for controlling a lighting circuit. The lighting circuit includes a LED lighting fixture having a string of light emitting semiconductor diodes (LEDs) and passive components. A micro-processor controlled driver of the LED lighting fixture is collocatable with a switch of the lighting circuit mountable in a switch box. The switch box includes a live wire input from a power source and a live wire output but no neutral wire.

A voltage drop may be measured across the lighting circuit. Responsive to the measured voltage drop, the power source may be signaled to supply a voltage level proportional to the measured voltage drop.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

The invention is herein described, by way of example only, with reference to the accompanying drawings, wherein:

FIG. 2 shows a drawing of a circuit schematic of the lighting installation shown in FIG. 1, according to conventional art.

Figure 1:
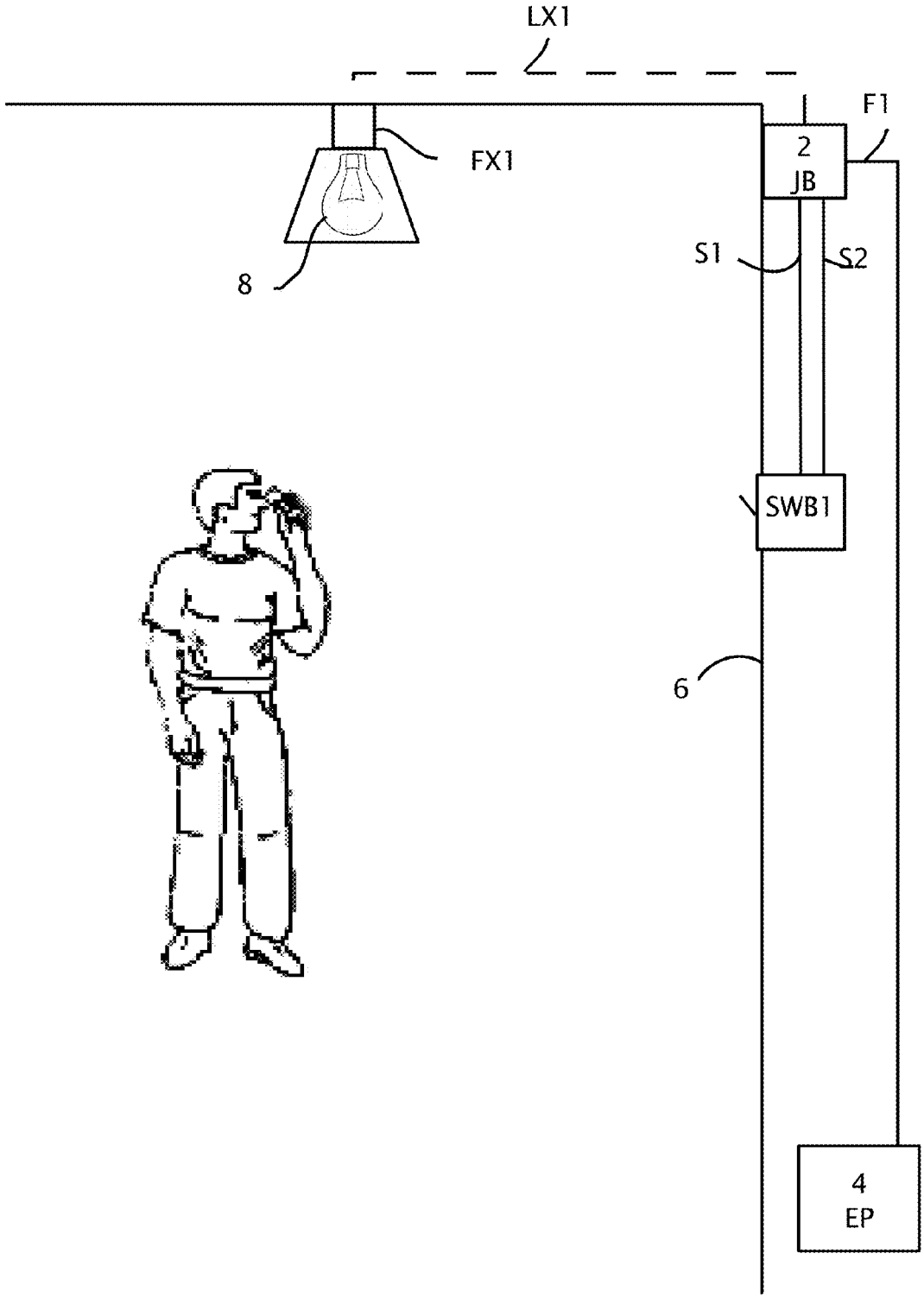
Fig. 1 Conventional Art
FIG. 1 shows a drawing of a lighting installation according to conventional art.

The foregoing and/or other aspects will become apparent from the following detailed description when considered in conjunction with the accompanying drawing figures.

DETAILED DESCRIPTION

Reference will now be made in detail to features of the present invention, examples of which are illustrated in the accompanying drawings, wherein like reference numerals refer to like elements throughout. The features are described below to explain the present invention by referring to the figures.

By way of introduction, various embodiments of the present invention are directed to illumination using light emitting diodes (LEDs). Recent advances of illumination LED design and manufacture include an increase in LED optical output (Lumens per Watt) which may have been achieved at least in part by reducing internal impedance of high output illumination LEDs. Reducing the internal impedance of the LED gives the benefit of reduced power loss in the LED (i.e. power loss is proportional to product of current squared and impedance). However, as LEDs heat up, the forward voltage drops and the current passing through the LED increases. The increased current generates additional heating of the junction. If nothing limits the current, the junction may fail due to excessive heat. This phenomenon is referred to as thermal runaway. There is an exponential relationship between the internal impedance of a LED and the inverse of temperature. Thus, with lower internal impedance, modern high output LEDs are more sensitive to temperature changes.

Moreover, variation of parallel loads could cause most of the output current to pass through the path of the load with the lowest voltage and a small amount of current through the path of the load with the highest voltage. The result would be a variation in light output and could cause LED failure from excessive current. Current balancing between parallel-connected strings is desired to achieve the same current to pass through each parallel string of series loads even though the voltage across each load is not necessarily the same.

As a result, in strings of interconnected LEDs of different lengths, some strings/LEDs may be on or off and/or with different operating parameters, particularly when strings are first turned on, may lead to increased current imbalances between the LED strings. High currents in some of the LED strings as a result may cause heat and thermal damage to the LEDs and/or LED strings. One possible partial solution to avoid thermal damage may be to utilize larger heat-sinks as part of a light fixture in order to avoid damage to the LEDs by virtue of the heat-sinks removing the increased heat. Another possible solution to avoid damage to the LEDs and/or LED strings is to employ multiple LED current/control driver circuits as part of the light fixture.

A typical operating junction temperature of a LED is around 130° C. which is much higher temperature compared to the heat-sink requirement for switching components used for a typical converter/regulator/driver circuit used to supply current to the LEDS. In a boost converter circuit for example, MOSFET and boost diode typically share the same heat sink with the maximum heat sink temperature regulated to 60° C. Therefore, if an array of LEDs as part of lighting fixture also includes the more temperature sensitive switching components, an increased potential failure of the lighting fixture may occur. The increased chances of the light fixture failing owing to the extra heat in the vicinity of the switching components causing the switching components and the light fixture to fail.

Thus there is a need for and it would be advantageous to have LED lighting fixtures where switching components used for regulating current supplied to LED lighting fixtures are located elsewhere other than in the LED light fixture itself in order to avoid early failure of the LED lighting fixture.

It should be noted that according to embodiments of the present invention, no neutral (N) connection is required in a switch box which is the case in conventional lighting circuits in which the existing wall switch does not include a neutral (N) connection. Thus, embodiments of the present invention may be used to enable replacement or retrofit of conventional luminaries with LED luminaries, without requiring a neutral wire to be added to the switch box by an electrician, which may sometimes be impossible.

Reference now made to the drawings and to FIG. 1 which shows a drawing of a lighting installation according to conventional art. The drawing shows locations of various parts of the lighting installation in a room of a building with a person standing in the room. Mounted into a wall 6 is a switch SWB1 which has two switch wires S1 and S2 which connect to a junction box 2. Junction box 2 receives a live L, neutral N and earth E alternating current (AC) voltage from an electrical panel 4 via a cable F1. electrical panel 4 may be located in another part of the building or outside the building. Electrical panel 4 may include circuit breakers for the various other lighting circuits as well as other circuits for their connection to an incoming alternating current (AC) voltage supplied by an electricity provider. A light fixture FX1 connects to and receives mains power as alternating current AC from junction box 2 via cable LX1. Light fixture FX1 is shown fitted with an incandescent lamp 8. Alternatively as is the case with United Kingdom (UK) lighting circuits, junction box 2 may be located in a ceiling rose which attaches electrically and mechanically to light fixture FX1.

Reference now is also made to FIG. 2 which shows a drawing of a circuit schematic of the lighting installation shown in FIG. 1, according to conventional art. Lighting fixture FX1, cable LX1 feeding lighting fixture FX1 from junction box 2 and cable F1 from electrical panel 4 to junction box 2 are shown in further detail. Electrical panel 4 includes multiple circuit breakers 40 used to protect the various circuits supplied with AC power via connections to multiple bus bars 42 which provide live L, neutral N and earth E. For the lighting installation of FIG. 2, junction box 2 receives live L, neutral N and earth E wires to provide alternating current (AC) power from electrical panel 4 via cable F1. Cable F1 is shown terminated in junction box 2 with terminals L, N and E. Switch supply wire S1 connects to live terminal L to switch box SWB1. The top switch of switch box SWB1 when switched on connects the live wire on terminal L to the live terminal L2 of incandescent lamp 8 via switch wire S2. The neutral terminal N of junction box 2 connects directly to incandescent lamp 8 and the E earth terminal connects to the chassis of light fixture FX1. Light fixture FX1 therefore connects to and receives AC power from junction box 2 via cable LX1. It is noteworthy that in a conventional installation shown in FIGS. 1 and 2 that switch box SWB1 does not include a neutral wire N, only live wires S1 and S2.

Direct Current Implementations

Figure 3:
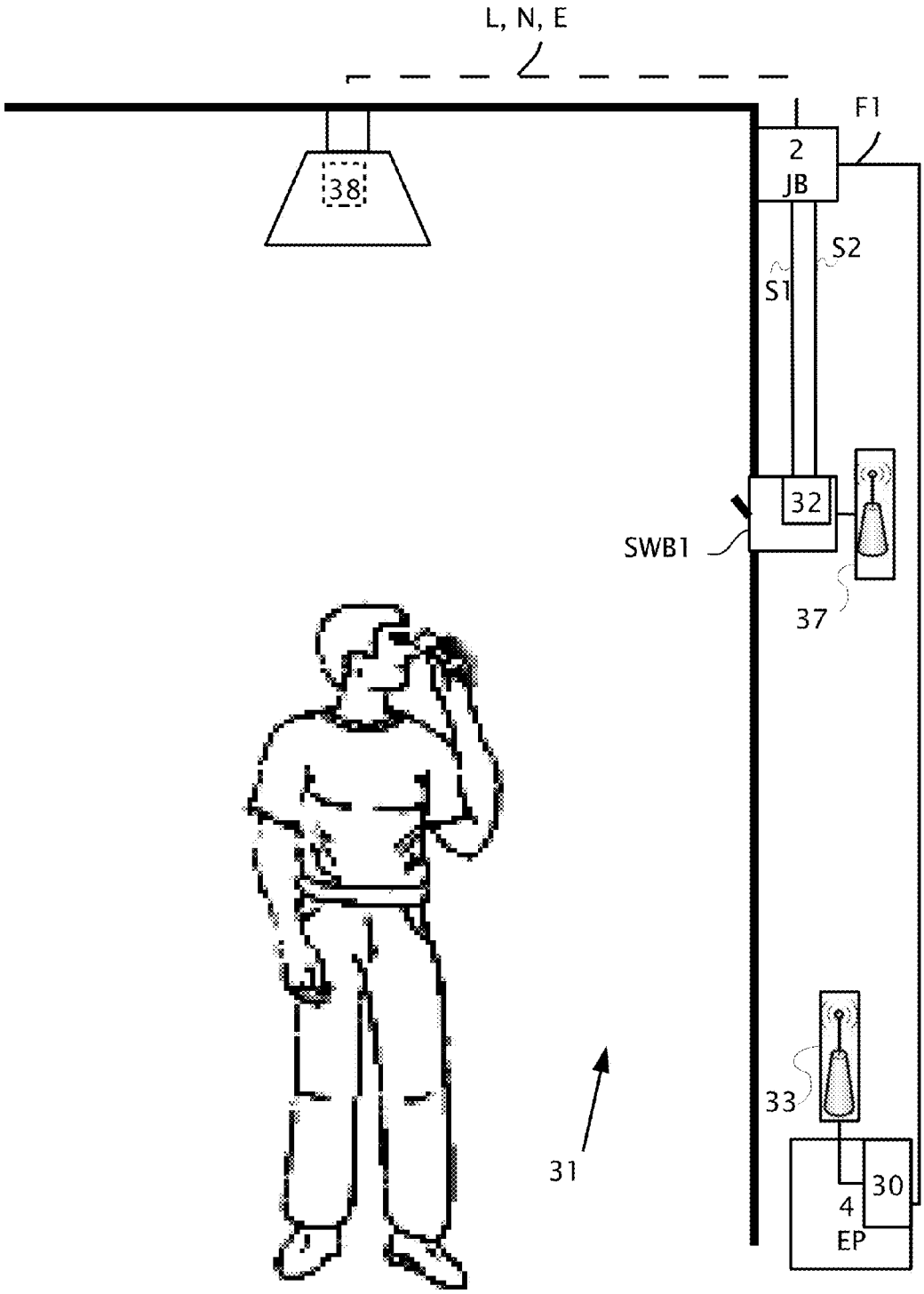
FIG. 3 shows a drawing of a lighting installation according to features of the present invention.

Reference is now made to FIG. 3 which shows a drawing of a lighting installation 31 according to features of the present invention. Lighting installation 31 includes a replacement of lighting fixture FX1 including an incandescent lamp 8 as in FIGS. 1 and 2 with a lighting fixture 38 which may include a light emitting diode (LED) array. Further included in installation 31 may be a power supply unit (PSU) 30 in or next to electrical panel 4 which may be an alternating current (AC) to direct current (DC) power source. A driver circuit 32 may be housed in switch-box SWB1.

Included with and connected to driver circuit 32 and PSU 30 may be respective communications interfaces, e.g. wireless interfaces 33 and 37. Communication using wireless interfaces 33 and 37 may be point-to-point, local using a smart phone application for example over a local area network, remotely using a connection over a wide area network for example to allow remote configuration and/or control of a lighting circuit optionally including configuration and control of individual LEDs and/or strings of LEDs within light fixture 38.

Figure 4:
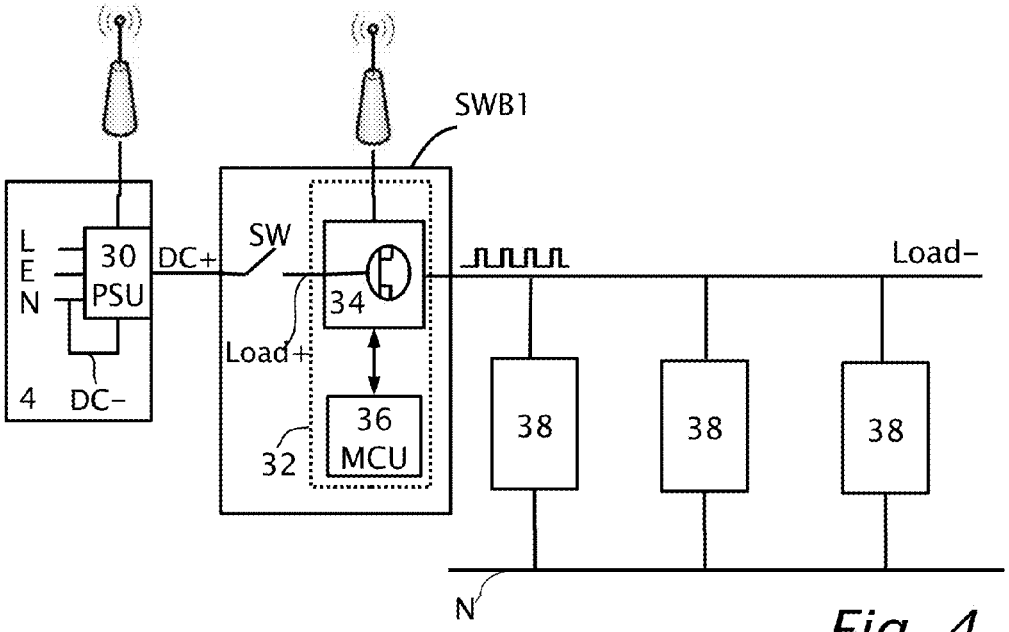
FIG. 4 shows a drawing including exemplary further details of a lighting installation as shown in FIG. 3, according to features of the present invention.

Reference now also made to FIG. 4 which shows a drawing including further details of lighting installation 31 as shown in FIG. 3, according to features of the present invention. PSU 30 is shown mounted in electrical panel 4. The AC wires live L, neutral N and Earth E are shown as input into power supply unit PSU 30. Live AC input L may be provided from circuit breaker 40 (shown in FIG. 2). The negative DC output DC− of PSU 30 may be connected to the neutral N wire. The positive DC output DC+ of PSU 30 may be connected to the live L terminal of junction box 2 (FIG. 2) and switch wire S1. The neutral N and earth E connections between electrical panel 4 and junction box 2 via cable F1 connect between electrical panel 4 as shown in FIG. 2. In other words, the addition of PSU 30 and connection between electrical panel 4 and junction box 2 allows live wire L of cable F1 to be used by positive DC output DC+ of PSU 30. The negative DC output DC− of PSU 30 may connect to the neutral N in electrical panel 32 to permit the operation of driver circuit 32 located in switch-box SWB1.

Referring back to FIG. 4, driver circuit 32 may include a micro-controller unit 36 optionally with on-board memory operatively connected to a power control switch 34. Power control switch 34 may receive an input voltage DC+ from PSU 30 via the light circuit switch or wall switch SW located in switch-box SWB1. The output of power control switch circuit 34 may be connected to parallel connected LED lamp fixtures 38. Neutral wire N is general absent in switch-box SWB1 as shown in FIG. 4. In the ensuing description in the context of FIG. 5B, it will be shown in embodiments of the present invention how power is initially provided to MCU 36 or other control circuit in absence of neutral wire N.

Figure 5A:
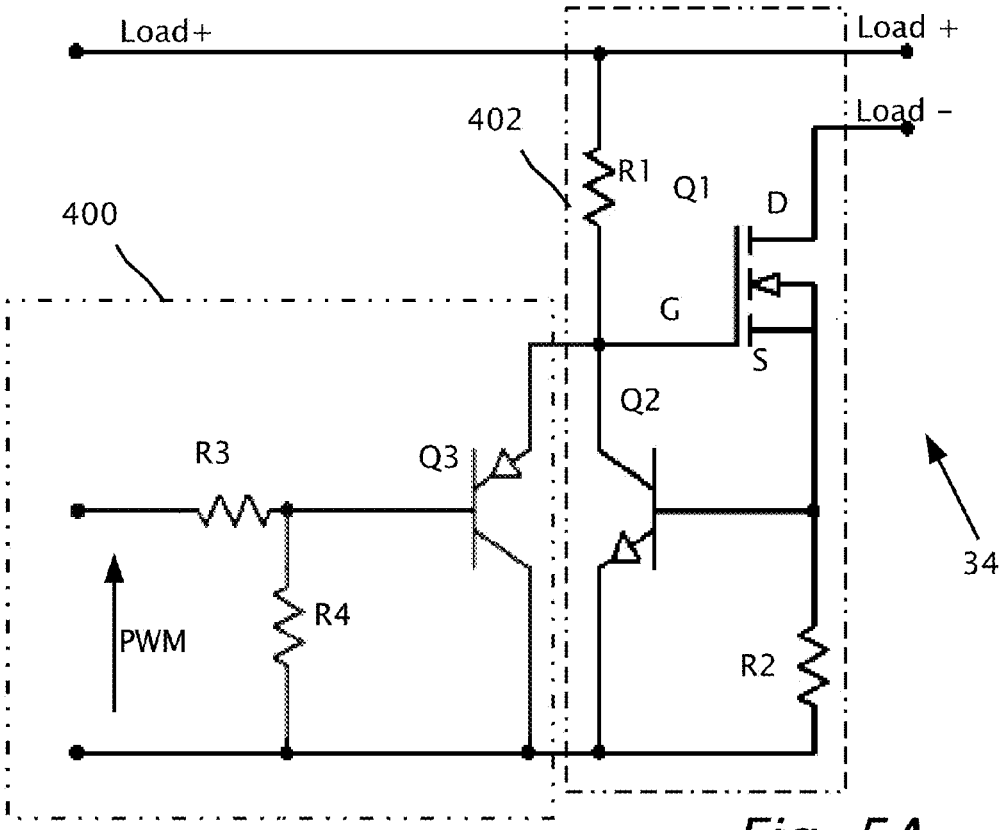
FIG. 5A, shows an exemplary power control switch circuit, part of a driver circuit which may be housed in a switch box according to features of the present invention.

Reference is now made to FIG. 5A, which shows an exemplary power control switch circuit 34 in greater detail, part of driver circuit 32 shown in FIG. 3 housed in switch box SWB1 according to features of the present invention. Power control switch circuit 34 is shown with two connected circuits 400 and 402.

Direct Current Linear Mode Operation

Circuit 402 on its own without circuit 400 may provide the function of a linear current regulator with fixed current value between terminals Load+ and Load− determined by selection of bias resistors R1, R2 based on the characteristics of 'n' type bipolar transistor (BJT) Q2 and insulated gate field effect transistor (IGFET) Q1.

Referring to the operation of linear current regulator 402, Q1 may operate entirely in linear mode and acts as a variable resistor to control current through a load (e.g. LED1 and L1) connected between Load+ and Load−. Resistor R1 keeps the gate of Q1 pulled to positive voltage so that Q1 starts up turned on. As the current begins to flow through the load, Q1, and R2, the voltage drop across R2 increases. When the drop across R2 reaches the "knee" or state-transition voltage for the emitter-base junction of Q2, Q2 begins to switch on, and in so doing starts to pull the gate of Q1 to the voltage at the emitter of Q3 which causes Q1 to increase its resistance, decreasing current flow through itself, the load, and R2, which decreases the drop across R2, causing Q2 to let the gate of Q1 float back toward positive supply, which increases the current flow. Within a few milliseconds, the current flow stabilizes around a specific set point determined by the value of R2.

Direct Current Switched Mode Operation

Still referring to FIG. 5A, circuits 400 and 402 connected together allows for pulse width modulation control of the current which flows between terminals Load+ and Load−.

The drain (D) of IGFET Q1 provides terminal output Load−. Terminal Load+ connects to DC+ and one end of resistor R1. The other end of R1 connects to gate G of IGFET Q1, the collector of 'n' type BJT Q2 and the emitter of 'p' type BJT Q3. The base of BJT Q2 is connected to the source S of IGFET Q1 and one end of resistor R2. The other end of R2 connects to the emitter of Q2 and the collector of Q3. The base of BJT Q3 connect to one end of respective resistors R3 and R4. The other end of R4 connects to the emitter of Q2 and the collector of Q3 and also provides one of the inputs of the PMW signal provided from the control of micro-controller 36. The other input of the PWM signal connects to the other end of resistor R3.

Current regulated operation through the load, e.g. LED lamp fixtures 38 may be provided by power control switch circuit 34 by the PWM signal from micro-controller 36 applied by MCU 36 to circuit 400 connected to circuit 402. The operation is as follows: Since Q3 is a 'p' type transistor and R4 biases the base of Q3 to ground, Q3 starts up turned on and pulls the gate of Q1 to ground regardless of what Q2 is doing, which in turn forces both Q1 and Q2 to turn off. R3 limits current draw to the PWM signal source and to provide a positive voltage greater than ~0.7 VDC to Q3 through R3, and Q3 turns off, which allows the rest of the regulator to function as described for linear current regulator 402 described above.

Figure 5B:
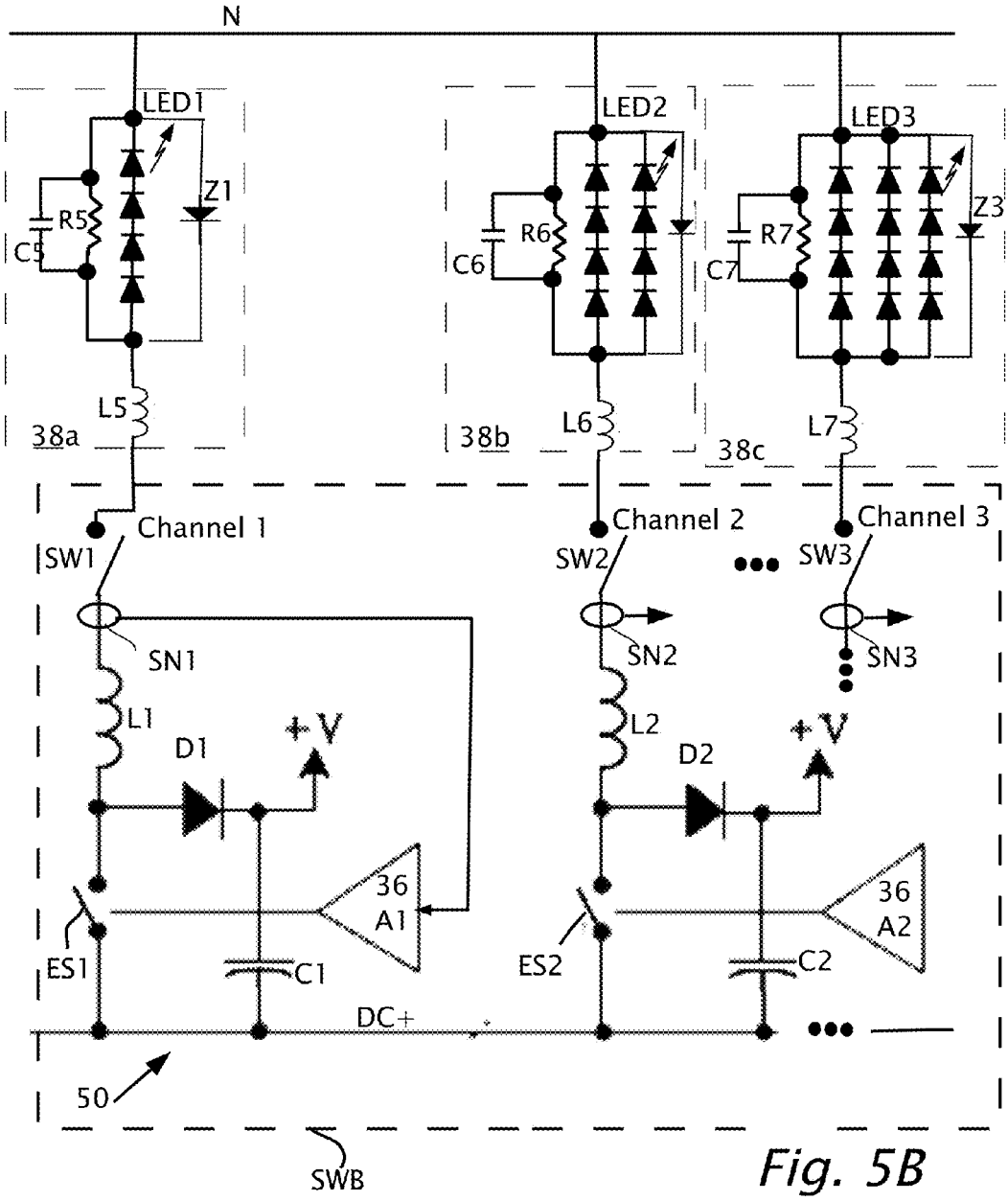
FIG. 5B shows a switch module mountable in a switch box according to features of the present invention.

Reference is now also made to FIG. 5B which shows a switch module 50 mountable in a switch box SWB according to features of the present invention. Exemplary switch module 50 includes three channels Channel 1 and Channel 2 are explicitly shown and Channel 3 is implicit. Channels 1-3 may individually control current to separate LED light fixtures 38*a*, 38*b* and 38*c* through separate wall switches SW1, SW2 and SW3 by use of respective switching power converter 34, e.g. buck circuits in switch-box SWB. Using connection to 38*a* as an example, the buck converter includes a capacitor C1 with one end connected to the cathode of a diode D1. The other end of capacitor C1 connects to DC+ which also connects to one end of electronic switch ES1 attached to buffer A1 which is operatively connected to or part of micro-controller unit 36. The other end of electronically controlled switch ES1 connects to one end of inductor L1 and the anode of diode D1. The other end of inductor L1 connects to LED lamp fixture 38*a* through wall switch SW1. Control of electronic switch ES1 to regulate current in LED lamp fixture 38*a* may be via linear means or by PWM as similarly discussed above with respect to power control switch circuit 34 shown in FIG. 5A. The voltage V+ located at the connection of the cathode of D1 and capacitor C1 may be utilized to supply voltage to micro-controller unit 36. Resistors R5, R6 and R7 and capacitors C5, C6 and C7 are connected in parallel across each respective LED lamp fixture 38*a*, 38*b* and 38*c*. Sensors SN1, SN2 and SN3 are operatively connected to MCU 36 (connection shown only for SN1) which may measure voltage and/or current and accordingly control the switches ES1 and ES2.

According to features shown in FIG. 5B, LED lamps 38*a*, 38*b* and 38*c* may have same rated operating voltage. However, lamps 38*a*, 38*b* and 38*c* may have different power ratings according to a different number of parallel strings. Internal parallel connected resistors R5, R6 and R7 respectively may be used to indicate lamp 38*a*, 38*b* and 38*c* power ratings.

LED lamp fixtures 38*a*, 38*b* and 38*c*, may include respective series connected inductors L1, L2 and L3 and a protection diode connected across each LED load. LED loads 38*a*, 38*b* and 38*c* and/or respective inductors L1, L2 and L3 are examples of LED arrays 38 located in a fixture FX2 as shown in FIG. 3.

Current balancing may be achieved, for strings of different LED types, different LED bins and/or number of LEDs per string by appropriate selection of the values of series load inductors L1, L2 and L3 depending on the current ($I_{LED}$) flowing through respective inductors into LED lamps 38*a*, 38*b*, 38*c* which are determined by respective power ratings. In general the LED current ($I_{LED}$) is a function of the inductor value, where:

$$I_{LED} = \frac{((DC+) - V_{LED}) \times T_{ON}}{2L}$$

Where $T_{ON}$ is the on time of the PWM signal.

The turn-on dynamics of switch module 50 mountable in a switch box SWB, according to a feature of the present invention may be provided as follows:

Wall switches SW1, SW2, SW3 are initially off. Micro-controller 36 and/or other control circuits such as circuit 34 (FIG. 5A) are initially powerless since a neutral wire N is not available in switch-box SWB. However, on closing a wall switch SW1, SW2, a DC current bypass (not shown in FIG. 5A) across power control switches ES1, ES2 may allow current to flow from DC+ in switch-box SWB through series inductors L5, L6 respectively and through resistors R5,R6 respectively to the neutral wire connecting LED light fixtures 38*a* and 38*b* respectively. By virtue of appropriate selection of parallel resistors R5,R6 values, the initial current flow is sufficient to charge capacitors C1, C2 respectively to provide voltage +V as shown, so that MCU powers up to control switching operation of power control switches ES1 and ES2. During the initial period prior to operation of light fixtures 38*a* and 38*b*, MCU 36 via sensors SN1, SN2 and SN3 for example, may detect current and thereby resistance of lamps 38. The voltage and/or initial current measured by MCU 36 using sensors SN1, SN2 and SN3 allows the selection of the appropriate operating current appropriate for the power rating of each lamp 38*a*, 38*b* and 38*c*.

Switched Alternating Current (AC) Operation

Figure 6:
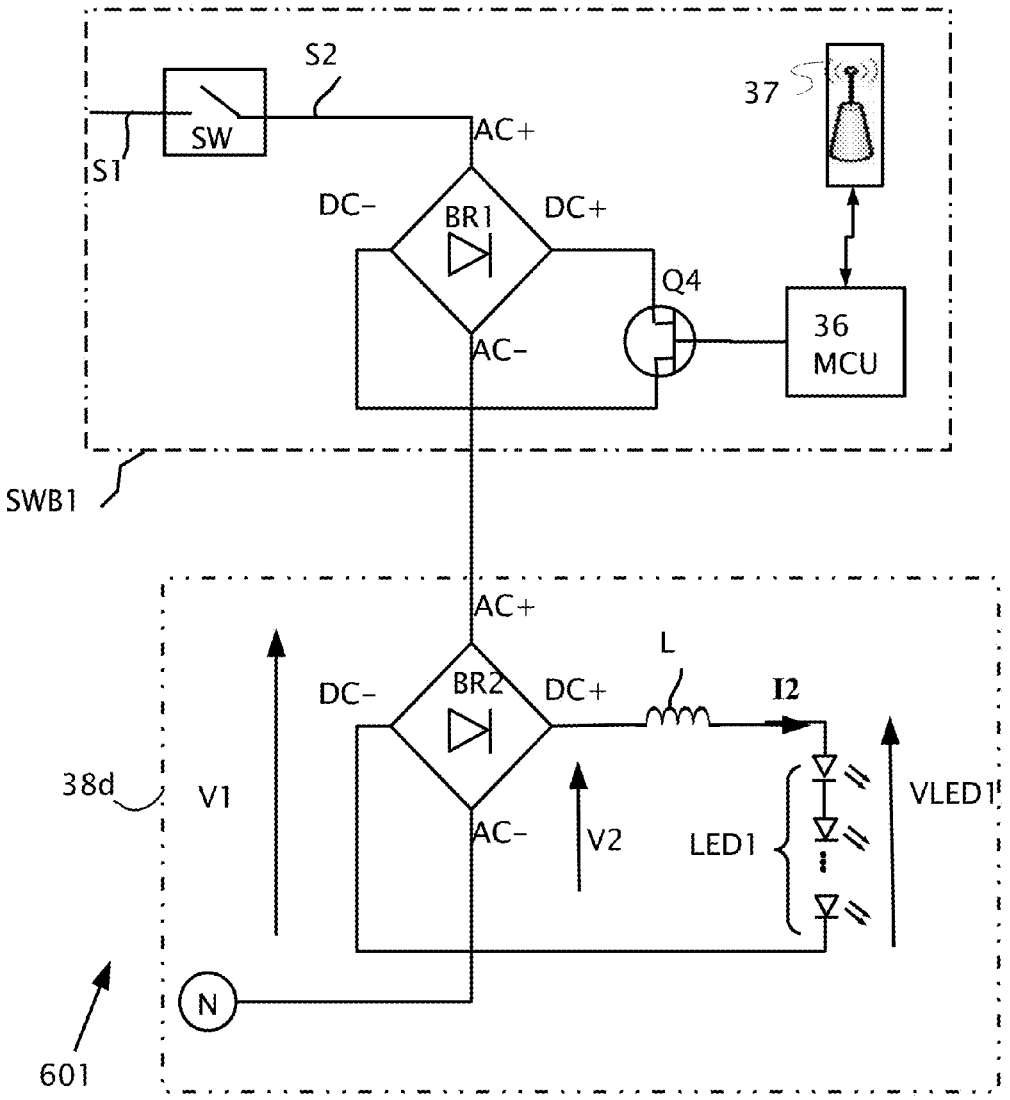
FIG. 6 shows a block diagram of an alternative AC implementation of operating a LED lamp fixture, according to features of the present invention.

Reference is now made to FIG. 6 which shows a block diagram 601 of an alternative AC implementation for operating an LED lamp fixture 38*d*, according to features of the present invention. Switch box SWB1 is shown with switch wires S1 and S2 connected across a wall switch SW. Referring back to FIG. 2, switch wire S1 connects to the AC live (L) of electrical panel 4 via feed cable F1 and junction box 2 so that the present embodiment may use mains power as supplied from electrical panel EP. Alternatively mains voltage may be converted to by a step-down transformer in electrical panel EP or elsewhere so that a lower AC RMS voltage, e.g. 24 VAC, is provided on switch wire S1 via feed cable F1 and junction box 2.

Switch wire S2 connects to terminal AC+ of bridge rectifier BR1, terminal AC− of bridge rectifier BR1 connects to terminal AC+ of bridge rectifier BR2 which is located in lamp fixture 38*d*. Terminal DC+ of bridge rectifier BR1 connects to onside of switch Q4 which may be the source of a MOSFET. The gate of the MOSFET connects to and is switched by MCU 36 which may receive its operating parameters via wireless interface 37 bidirectionally connected to MCU 36. The drain of the MOSFET connects to terminal DC− of bridge rectifier BR1.

Terminal DC+ of bridge rectifier BR2 connects to one side of inductor L and the other side of inductor L connects to the anode end of LED1, the cathode end of LED1 connects to terminal DC− of bridge rectifier BR2. Terminal AC− of bridge rectifier BR2 connects to the neutral (N) connection inside lamp fixture 38*d* via feed cable F1 and junction box 2.

Figure 6A:
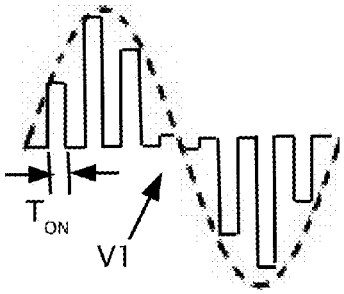
FIGS. 6A, 6B and 6C shows two voltage wave-forms and a current waveform respectively, according to embodiments of the present invention as in FIG. 6.
Figure 6B:
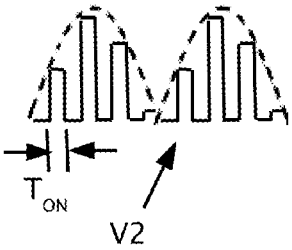
Figure 6C:
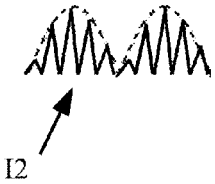

Reference is now made to FIGS. 6A, 6B and 6C which shows two voltage waveforms and a current waveform respectively, according to a feature of the present invention. FIGS. 6A, 6B and 6C show the operation of lamp fixture 38*d* by MCU 36 to control the flow of current I2 in LED1. Voltage V1 is shown in solid line in FIG. 6A with the AC voltage on switch wire S2 shown superimposed over V1 by dashed line. V1 includes on pulses ($T_{ON}$) and periods where there is no voltage. The duration of the on pulse and the periods where there is no voltage for V1 is determined by the switching and control of switch Q4 by MCU 36. V1 is rectified by bridge rectifier BR2 to give voltage V2 which is applied across LED1. Current flowing through L and LED1 may be according to the equation shown above where $I2=I_{LED}$, DC+=V2 and VLED=VLED1 is given by:

$$I_{LED} = \frac{((DC+) - V_{LED}) \times T_{ON}}{2L}$$

Figure 6D:
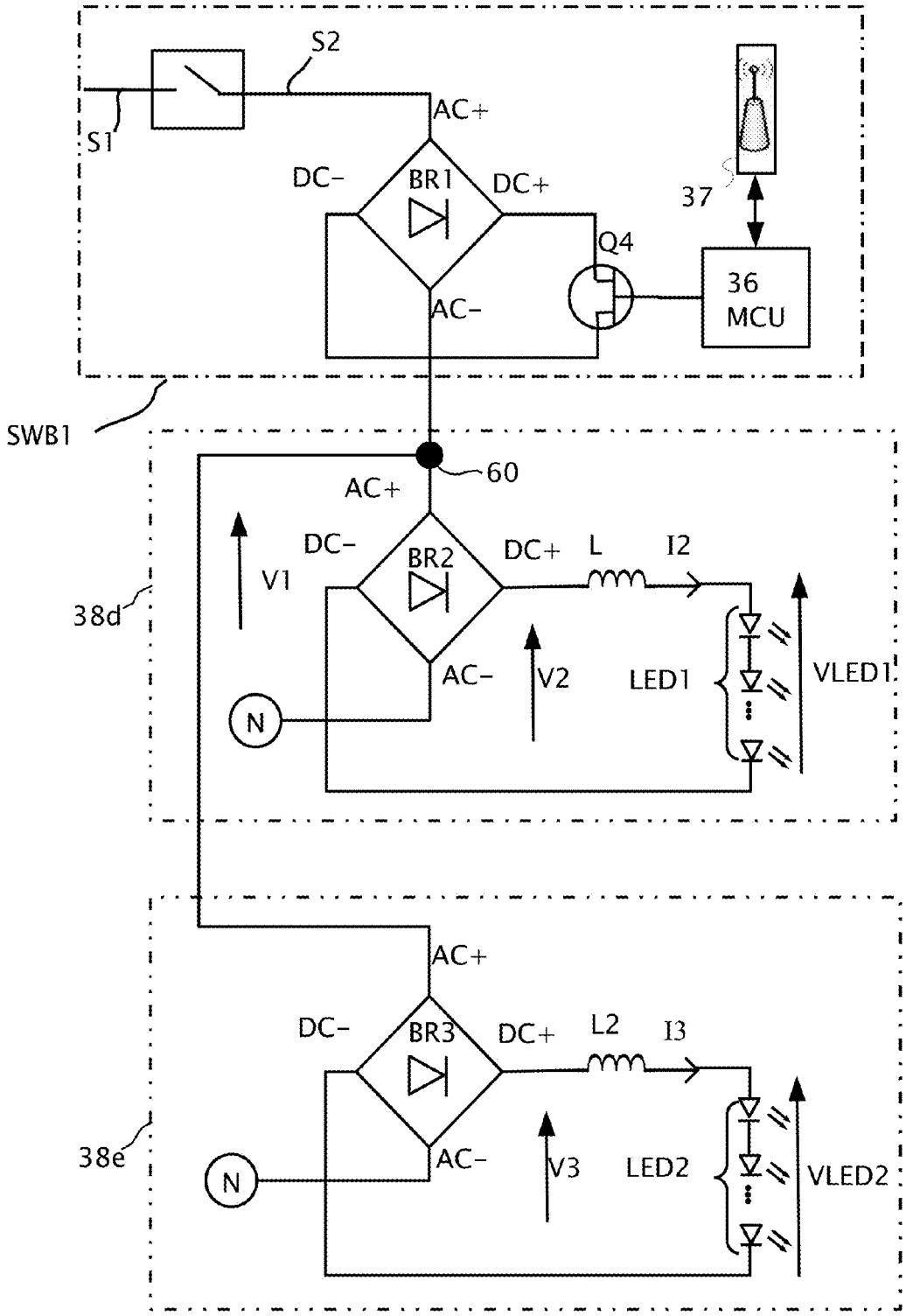
FIG. 6D shows connection of a second lamp fixture to the embodiment of the present invention as shown in FIG. 6.

Reference is made to FIG. 6D which shows the connection of a second lamp fixture 38*e* according to a feature of the present invention. Lamp fixture 38*e* connects at terminal node 60 which is the connection between terminal AC− of bridge rectifier BR1 and terminal AC+ of bridge rectifier BR2. Additional lamp fixtures similar to lamp fixtures 38*d* and 38*e* may be attached to terminal node 60. Different LED lamp fixtures may be connected to terminal 60 using lamp fixture 38*e* where different type of LEDs and/or number of LEDs are used. In lamp fixture 38*e*, L2 may be selected according to the above equation to ensure that I3 flows through L2 and LED2 and the voltage VLED2 applied to LED2 are the correct values.

Figure 7:
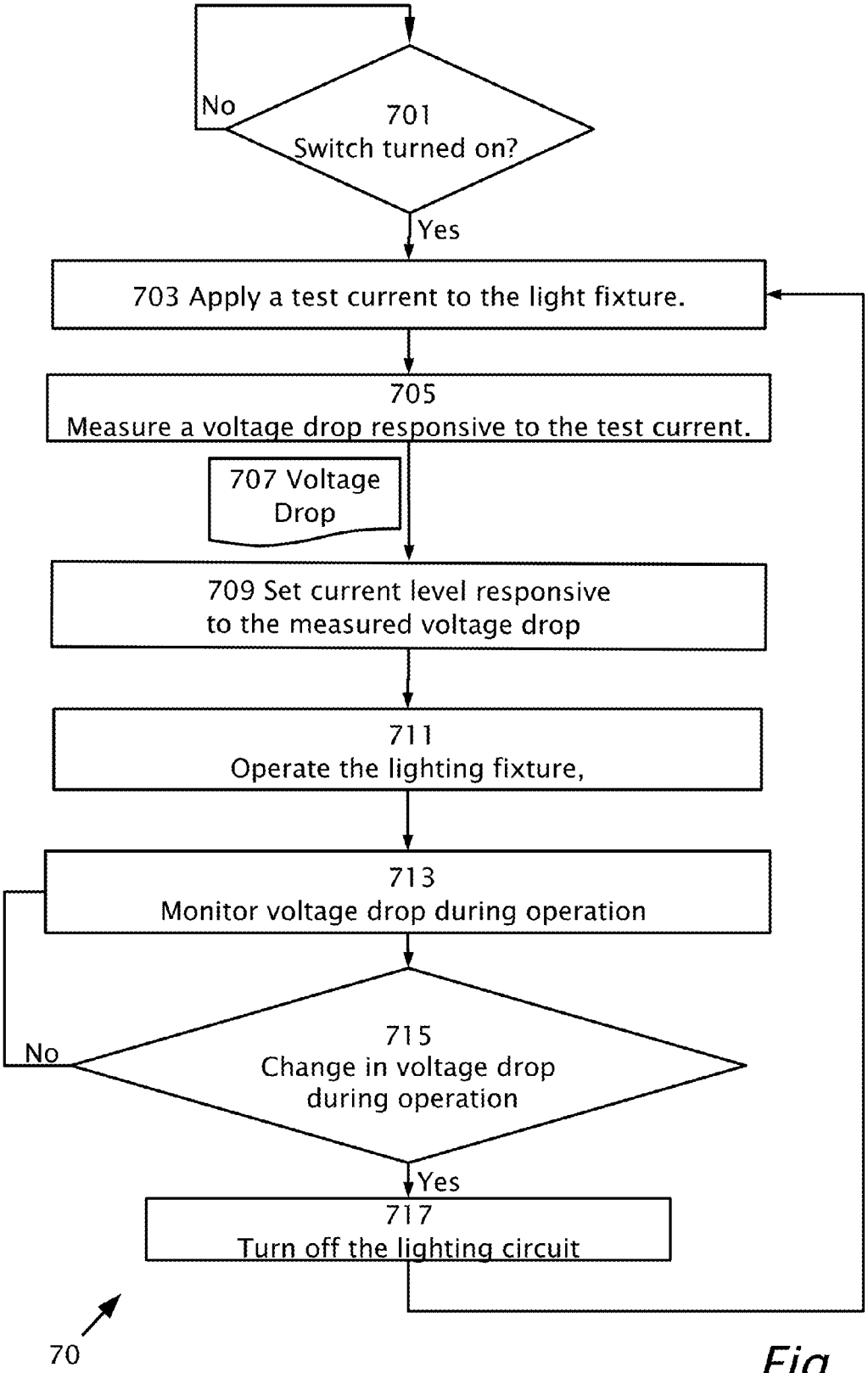
FIG. 7 illustrates a method according to features of the present invention.

Reference is now also made to FIG. 7, which illustrates a method 70 according to features of the present invention. All lamps 38 may have the same rate operating voltage but may have different power ratings. Power ratings may be indicated by internal parallel connection of an indicating resistor, such as R5,R6, R7 shown in FIG. 5B. When wall light switch SW is turned on (decision box 701), a test current may be applied to lighting fixture 38. A voltage drop 707 is measured (step 705) which is proportional to the applied test current and the internal lamp resistance. The resistance of lamp 38 may be detected and if more than one lamp 38 is parallel-connected in the same channel, the combined resistance provided by the internal parallel connected resistors, indicates the correct power rating of parallel-connected lamps 38. The current level may be set (step 709) responsive to the measured voltage drop. Lighting fixture 38 may be operated (step 711) at the correct current rating. During operation (step 711) a voltage drop is monitored at the operating current. If a transient voltage drop is sensed (step 715) which may occur for instance if another parallel-connected lamp is attached during operation of a first lamp, then the lighting circuit is turned off (step 717) and a test current is reapplied (step 705) so that the current may again be set (step 709). Parallel-connected internal capacitors, (for instance C5, C6 and C7 shown in FIG. 5B) in combination with parallel connected internal resistors R5, R6 and R7 provide the measurable transients during operation.

Figure 8:
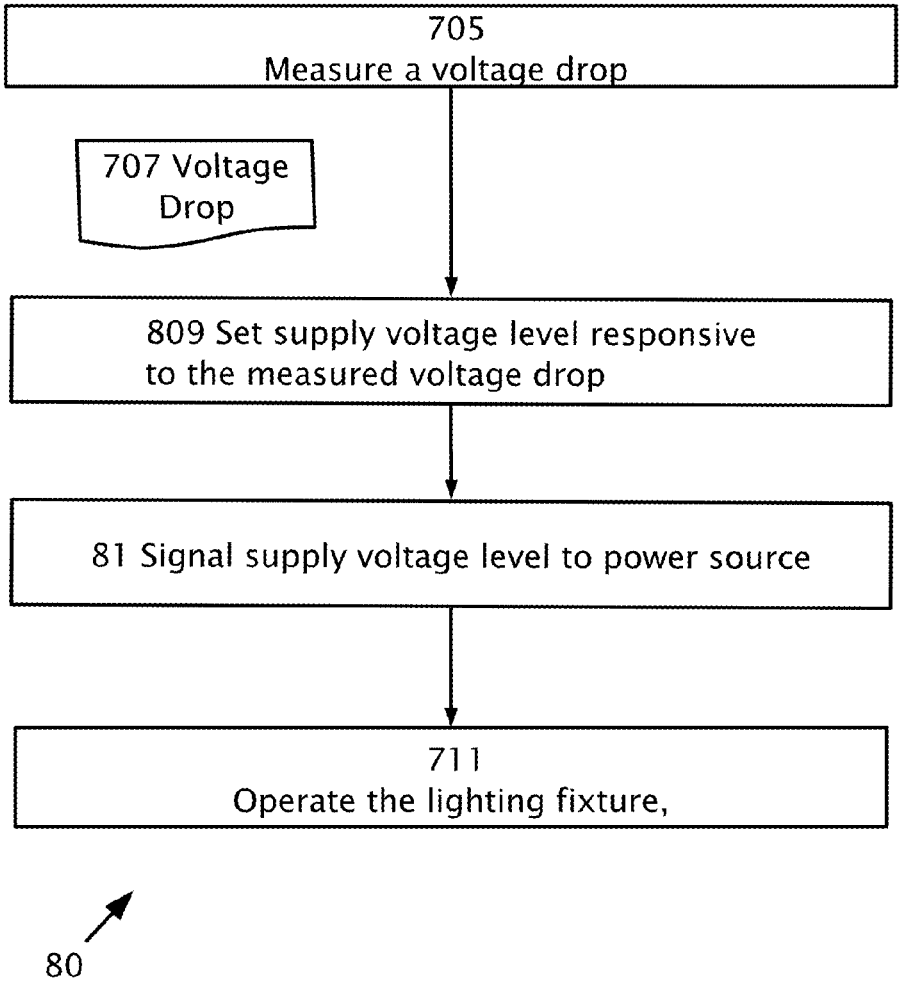
FIG. 8 illustrates a method according to features of the present invention.

Reference is now also made to FIG. 8, which illustrates a method 70 according to features of the present invention. As in method 70, a voltage drop across lamp 38 may be measured for instance responsive to a test current. In step 809, a supply voltage level may be determined responsive to the measured voltage drop. The optimal supply voltage level is generally slightly higher than the voltage drop across the lamps 38 at operating current. In step 81, the power source, for instance power source 30 as shown in FIG. 3 may be signaled using for instance wireless communications interfaces 37 and 33 to supply a minimum voltage to increase efficiency of the lighting circuit. In this way, power losses may be reduced to a minimum.

Another feature according to aspects of the invention concerns the ability of driver circuit 32, switch module 50 and micro-controller unit 36 shown in FIGS. 4, 5B and 6D respectively to sense and measure the operating voltage and current of LED1, LED2 and LED3 for example. The operating voltage and current of LED1, LED2 and LED3 may be measured and sensed more readily since there may be no active driver circuitry in lamps 38 or that a LED lamp bulb may now no longer require active driver circuitry according to features of the present invention.

The temperature of each LED1, LED2 and LED3 for example to be monitored is by virtue of a standard diode equation for the type of LED used in each LED1, LED2 and LED3. The standard diode equation is:

$$I = I_0(e^{\frac{qV}{kT}} - 1)$$

I=the net current flowing through the diode;

$I_0$="dark saturation current", the diode leakage current density in the absence of light;

V=applied voltage across the terminals of the diode;

q=absolute value of electron charge;

k=Boltzmann's constant; and

T=absolute temperature (K).

The "dark saturation current" ($I_0$) is a parameter which differentiates one LED from another. $I_0$ is a measure of the recombination in an LED. An LED with a larger recombination will have a larger $I_0$. The differentiation between one LED type used in LED 1 for example and another use in LED2 or LED3 and the number of LEDs in each of LED1, LED2 and LED3 may be stored in look up table in memory of MCU 36 to allow the temperature of LED1, LED2 and LED3 to be monitored and controlled.

The formula above may be linearized by taking a natural logarithm of both sides and used as a model to determine junction temperature as a function of measured voltage of and current through LED1, LED2 or LED3.

If the above formula is used then the model equation used to model temperature as a function of voltage and current is: $V(I,T)=CT\ (\log(I/I_0)+1)=CT(\log(I)-\log(I_0)+1)$ where C, $I_0$ are constants Alternatively, another model may be used as follows:

$V(I,T)=A*T+B+(C*T+D)*I+E*1n(I)$ wherein A,B,C D and E are adjustable parameters. "*" is the multiplication operator.

I=current through LED1, LED2 or LED3 in milli-amps (mA)

V=Total voltage measured across LED1, LED2 or LED3.

T=LED Junction temperature in ° C.

I=LED current in mA.

An assumption is made that junction temperature T in the steady state is greater than the heat-sink temperature of a LED fixture 38 and/or LED lamp bulb by a constant temperature difference, which may be available from the LED manufacturer or estimated. Heat sink temperature of a LED fixture 38 and/or LED lamp bulb may be measured for different voltages and currents (minimum of five different voltage/current points may be required) and parameters are determined for LED1, LED2 and LED3. The parameters determined as well as the sensed and measured operating voltage and current of LED1, LED2 and LED3 during operation, may allow for a thermal protection of LED1, LED2 and LED3 which cuts-off the flow of current through LED1, LED2 and LED3 when the junction temperatures of LED1, LED2 and LED3 are too high. Another aspect is when there are a small number LED lamps 38 and/or LED lamp bulbs connected to the same lighting circuit output channel, Channel 1 for example. Due to the flow of unbalanced currents, one LED fixture 38 and/or LED lamp bulb current may be too high compared to the other which may indicate a thermal run away of LEDs in LED fixture 38 and/or LED lamp. According to features described above, the thermal run away of LEDs in LED fixture 38 and/or LED lamp may be detected instantly and a protection activated so that the operational current of a LED fixture 38 and/or LED lamp is reduced until an acceptable thermal operation temp of the LED fixture 38 and/or LED lamp is achieved.

The term "illumination" as used herein refers to the provision of visible light in the environment typically white light to enable or improve visibility of objects in the environment.

The term "electrical power source" or "power source" as used herein interchangeably may be an AC to AC transformer, a voltage controlled or regulated power supply and/or a current controlled power source (sometimes known as a "ballast" or current driver) in different embodiments of the present invention. The "electrical power source" as used herein may supply direct current (DC) or alternating current (AC) in different embodiments of the present invention.

The term "white light" as used herein re LED strings 13 refers to visible light when all or most of the colors of the visible light spectrum are combined.

The term "photo metric" as used herein is a measure perceived brightness to the human eye.

The term "drive" or "driver" as in "a drive current" for example, refers to an electrical circuit or other electronic component used to provide the power to another circuit or other component. Control of the drive current may be by a microprocessor for example.

The terms "microprocessor", "micro-controller", "controller", "controlled driver and "control circuit" as used herein are used interchangeably and refers to any control circuit known in the art of power electronics.

The terms "electrical panel", "consumer unit", "distribution board", "distribution panel" and "fuse box" as used herein are used interchangeably.

The terms "light emitting diode (LED) lighting fixture" and "LED lamp bulb" as used herein are used interchangeably.

The terms "light fixture", "luminaire" and "light fitting" are used interchangeably and refer to lighting or illumination using light emitting diodes.

The term "control circuit" as used herein may be implemented in a "microprocessor", "micro-controller" or in a dedicated control circuit.

The term "pins" as used herein for electrical connections may be male or female and may have any geometric cross section.

The term "active" as used herein in the context of "active driver components" includes devices which draw electrical power such as transistors.

The term "passive" as used herein in the context of "active driver components" includes devices which do not require electrical power such as resistors, inductors, capacitors. Diodes constructed into diode bridge rectifier are considered a "passive" component because in the bridge rectifier configuration power is not drawn.

The indefinite articles "a", "an" is used herein, such as "a converter", "a connector" have the meaning of "one or more" that is "one or more converters" or "one or more connectors".

All optional and preferred features and modifications of the described embodiments and dependent claims are usable in all aspects of the invention taught herein. Furthermore, the individual features of the dependent claims, as well as all optional and preferred features and modifications of the described embodiments are combinable and interchangeable with one another.

Although selected features of the present invention have been shown and described, it is to be understood the present invention is not limited to the described features. Instead, it is to be appreciated that changes may be made to these features without departing from the principles of the invention, the scope of which is defined by the claims and the equivalents thereof.

What is claimed is:

1. A switch module configured to switch a lighting circuit, the switch module mountable in a switch box, wherein the switch box includes a live wire input configured to receive electrical power over a live wire from a power source and wherein the switch box includes a live wire output but no neutral wire, the switch module comprising:

a switch with a first terminal connectable to the live wire input and a second terminal;

a driver circuit with input from the second terminal of the switch and with an output connected to the live wire output, wherein the driver circuit outputs electrical power to the lighting circuit over the live wire output; and a controller connected to the driver circuit, wherein the controller is configured to control at least one of voltage, current, pulse width and pulse duty cycle of the electrical power to the lighting circuit, wherein the controller is powered by charge stored in the switch module from current flowing through a neutral wire in the lighting circuit.

2. The switch module of claim 1, wherein the controller is configured to analyze the electrical power to the lighting circuit to indicate the temperature of the lighting circuit.

3. The switch module of claim 2, wherein the controller is configured to control at least one of voltage, current, pulse width and pulse duty cycle of the electrical power to the lighting circuit responsive to the temperature.

4. The switch module of claim 1, further comprising:

a communications module operable to communicate with the power source to control voltage output of the power source.

5. The switch module of claim 1, further comprising:

a communications module operable to communicate with a computer system to control power in the lighting circuit.

6. The switch module of claim 1, wherein said power supply is located inside or in the vicinity of an electrical panel.

7. A lighting circuit kit for retrofitting a conventional lighting circuit, the lighting circuit kit comprising:

a switch module configured to switch the lighting circuit, the switch module mountable in a switch box, wherein the switch box includes a live wire input and a live wire output but no neutral wire, the live wire input configured to receive electrical power over a live wire from a power source, the switch module including: a switch with a first terminal connectable to the live wire input and a second terminal, a driver circuit with input from the second terminal of the switch, wherein the driver circuit outputs electrical power to the lighting circuit over the live wire output, a controller connected to the driver circuit, wherein the controller is configured to control any of voltage, current, pulse width and pulse duty cycle of the electrical power to the lighting circuit;

a light emitting diode (LED) lighting fixture including a string of light emitting semiconductor diodes (LEDs); and wherein the controller is powered by charge stored in the switch module from current flowing through a neutral wire in the light emitting diode (LED) lighting fixture.

8. The lighting circuit kit of claim 7, further comprising:

a passive electronic component connected to the string of LEDs, wherein a value of the passive electronic component is selected to indicate current rating of the lighting fixture.

9. The lighting circuit kit of claim 8, wherein the passive electronic component includes a resistor connected in parallel with the string of LEDs, wherein a value of the resistor is selected to indicate current rating of the lighting fixture.

10. The lighting circuit kit of claim 9, further including:

a capacitor connected in parallel to the resistor configured to provide a transient detectable by the driver of the LED lighting fixture which indicates a change in load during operation.

11. The lighting circuit kit of claim 8 wherein the passive electronic component includes an inductor connected in series with the string of LEDs, wherein the inductor is selected to control load and current through the string of LEDs.

12. The lighting circuit kit of claim 7, wherein the switch module includes a communications module operable to communicate with the power source to control voltage output of the power source.

13. The lighting circuit kit of claim 7, wherein the switch module includes a communications module operable to communicate with a computer system to control voltage current through the LED lighting fixture.

14. A method for controlling a lighting circuit, wherein the lighting circuit includes a LED lighting fixture having a string of light emitting semiconductor diodes (LEDs) and passive components, wherein a controlled driver of the LED lighting fixture is collocatable with a switch of the lighting circuit mountable in a switch box, wherein the switch box includes a live wire input from a power source and a live wire output but no neutral wire, the method including the steps of:

upon the switch being turned on, measuring a voltage drop responsive to initial current through the light fixture;

driving an operating current to the lighting fixture thereby operating the lighting fixture, the current level during operation being responsive to the measured voltage drop;

monitoring for a change in voltage during operation; and if a change in voltage drop is sensed during operation, then turning off the lighting circuit then re-setting the current level for further operation responsive to an initial current after the turning off.

15. The method of claim 14, further comprising:

initially powering the controlled driver from the initial current between the live wire in the switch box through the light fixture.

16. The method of claim 14, further comprising:

responsive to the measured voltage drop, signaling to the power source to supply a voltage level proportional to the measured voltage drop.

* * * * *